United States Patent [19]

Beane et al.

[11] Patent Number: 4,905,868

[45] Date of Patent: Mar. 6, 1990

[54] PAPER TOWEL DISPENSER NOZZLE HAVING A FLANGE AND A CONICAL FUNNEL

[76] Inventors: Stephen B. Beane, 3545 Docksider Dr., S., Jacksonville, Fla. 32217; Ernest A. De Boliac, 16100 SW. 272 St., Homestead, Fla. 33030

[21] Appl. No.: 140,279

[22] Filed: Dec. 31, 1987

[51] Int. Cl.[4] ..... A47K 10/24; B65H 1/00

[52] U.S. Cl. ..... 221/44; 221/46; 221/48; 221/63

[58] Field of Search ..... 221/63, 48, 47, 33, 221/44, 45, 46; 206/205, 409–410; 225/106; 222/567, 569

[56] References Cited

U.S. PATENT DOCUMENTS

| | | | |
|---|---|---|---|
| 2,981,449 | 4/1961 | Perkins | 222/569 X |
| 4,180,160 | 12/1979 | Ogawa et al. | 221/63 X |
| 4,262,816 | 4/1981 | Margulies | 221/63 X |
| 4,648,530 | 3/1987 | Granger | 221/63 X |
| 4,651,895 | 3/1987 | Niske et al. | 221/63 |

*Primary Examiner*—Joseph J. Rolla
*Assistant Examiner*—Mona Beegle
*Attorney, Agent, or Firm*—Fitzpatrick, Cella, Harper & Scinto

[57] ABSTRACT

A dispenser nozzle for a paper towel container holding a roll of perforated paper towels includes a flange for coupling the nozzle apparatus to the container. A conical funnel is integral with the flange and has an entrance opening adjacent the flange to receive the paper towels therethrough. The other end of the funnel has an exit hole which is smaller than the entrance hole and provides an exit for the paper towels passing through the funnel. The entrance opening and exit opening are dimensioned such that a first paper towel will separate from a following paper towel along the perforation boundary therebetween when a leading portion of the following paper towel has exited from the exit opening in the funnel. Preferably, the exit portion of the funnel includes at least one removable section in order that the nozzle may be adjusted for different sizes of paper towels to be dispensed.

20 Claims, 2 Drawing Sheets

PAPER TOWEL DISPENSER NOZZLE HAVING A FLANGE AND A CONICAL FUNNEL

The present invention relates to a dispenser nozzle for a paper towel container, and more particularly to a dispenser nozzle which allows a paper towel to be separated along a perforation boundary from a following paper towel after a leading portion of the following paper towel has exited from the nozzle.

Paper towels are extremely popular for cleaning, absorbing, and many other well known uses. Typically, paper towels are supplied from the manufacturer as a rolled continuous web of paper sheets. Thus, each paper towel is separated from its neighbor by a perforated area, or an area of weakened structure. This permits the user to tear one or more paper towels from the roll. However, it is well known that the quality of perforations varies widely from manufacturer to manufacturer, thus making the tearing operation inexact. The phenomenon of half-torn paper towels is familiar to all paper towel users. Therefore, it has become popular to supply paper towel users with paper towel dispensers which can carry the roll of paper towels and ease the tearing operation. However, known paper towel containers still do not provide a sufficiently accurate structure to ensure a reliable and accurate tear.

Many proposals have been made in order to provide structure for accurately separating one towel from another in a continuous web of perforated towels. For example, U.S. Pat. No. 4,262,816 to Margulies discloses a container and dispensing plate for a roll of premoistened towelettes. FIGS. 6–11 of this patent disclose a thin, flexible dispenser plate which is placed on top of a roll of towels. The dispenser plate may be formed in a conical shape with an aperture at the tip thereof. The aperture is large enough to allow the towelettes to be drawn therethrough, and at the same time provides enough friction to the web of towels so that each towelette will separate at the perforation as it is pulled through the aperture. However, a difficulty in this construction is that the then dispenser plate is allowed to float freely on top of the paper towel roll. Several flaps in the container assembly are folded over the conical dispenser plate in order to arrest the movement of the conical dispenser plate as the user pulls up on a towel. This floating dispenser plate may become wedged in an improper position and obstruct the dispensing of towels from the container. In addition, the numerous contacts between the conical dispenser plate and the flaps causes wear and subsequent distortion to each of these members, especially the thin dispenser plate. This eventually reduces the accuracy and reliability of the towel dispenser. In addition, the conical dispenser plate of Margulies is assembled by placing a slit in a thin, flat disk and then overlapping portions of the disk. Therefore, a separation exists between various portions of the conical structure. Dispensing towels may be caught in this separation and thus jam the dispenser. Furthermore, paper towels may be caught and snagged at the separation, thus causing tearing of the towel at an unperforated section. Finally, the construction of the dispenser plate according to Margulies requires assembly by a user and constant movement from one dispenser to another. Therefore, the conical dispenser plate of Margulies is not adaptable for industrial use and other high volume paper towel uses.

Several other examples of previously patented towel dispensers include: U.S. Pat. No. 4,180,160 to Ogawa et al., wherein a flexible dome structure is used to dispense the towels while retaining moisture within the container; U.S. Pat. No. 1,878,399 to Hope, wherein a wide-mouth, neck strip dispenser causes folded towels to tear along their perforations; U.S. Pat. No. 4,648,530 to Granger, wherein a circular, venturi-shaped dispensing nozzle is used to dispense rolled paper products; and U.S. Pat. No. 843,579 to Burr et al., wherein rolled paper products are dispensed from a contoured mouth assembly. While all of these known dispensers seem to function adequately, there all have drawbacks. The major drawback common to all known dispensers is that they currently require expensive materials for forming the package, much hand labor, and ultimate disposal of the spent dispenser. In addition, each of the known dispensers has a fixed hole therein so that only one size of paper towels may be dispensed therethrough. For example, it is known that paper towels come in one-ply, two-ply, and even three-ply configurations. Thus, a dispenser for a one-ply towel would be unusable for a three-ply towel.

Therefore, what is needed is a simple preformed dispenser nozzle capable of being affixed to a paper towel container in order to reliably and accurately dispense paper towels so that each towel separates along its perforation boundary.

SUMMARY OF THE INVENTION

It is therefore an object of the present invention to provide a novel, non-obvious dispenser nozzle apparatus for accurately and reliably dispensing a continuous web of rolled paper towels.

This and other objects of the invention are achieved by providing a dispenser nozzle for a paper towel container holding a roll of perforated paper towels. A circular flange includes means for coupling the flange to the paper towel container. Integral with the flange is a conical-shaped funnel for passing the paper towels therethrough. The conical shape causes each paper towel to be compressed as it moves along the funnel. The friction between the paper towel and the inside of the funnel eventually cause the paper towel to be separated from its neighbor along the perforation boundary therebetween. However, the breaking at the perforation boundary does not occur until a leading portion of the following paper towel has exited from the funnel. Thus, the user has a readily available portion of the following paper towel to grasp for the next operation.

BRIEF DESCRIPTION OF THE DRAWINGS

The advantageous structure and functions of the presently claimed invention will be readily understandable from the following detailed description of the presently preferred embodiment when taken together with the drawings in which:

DETAILED DESCRIPTION OF THE PRESENTLY PREFERRED EXEMPLARY EMBODIMENT

While this invention is described with respect to a dispenser nozzle for a paper towel container, those of ordinary skill in this field will readily perceive that the teachings of this invention may be adapted to other dispensers. The adaptation of the present invention to such other dispensers is to be included within the scope of the appended claims.

Figure 1:
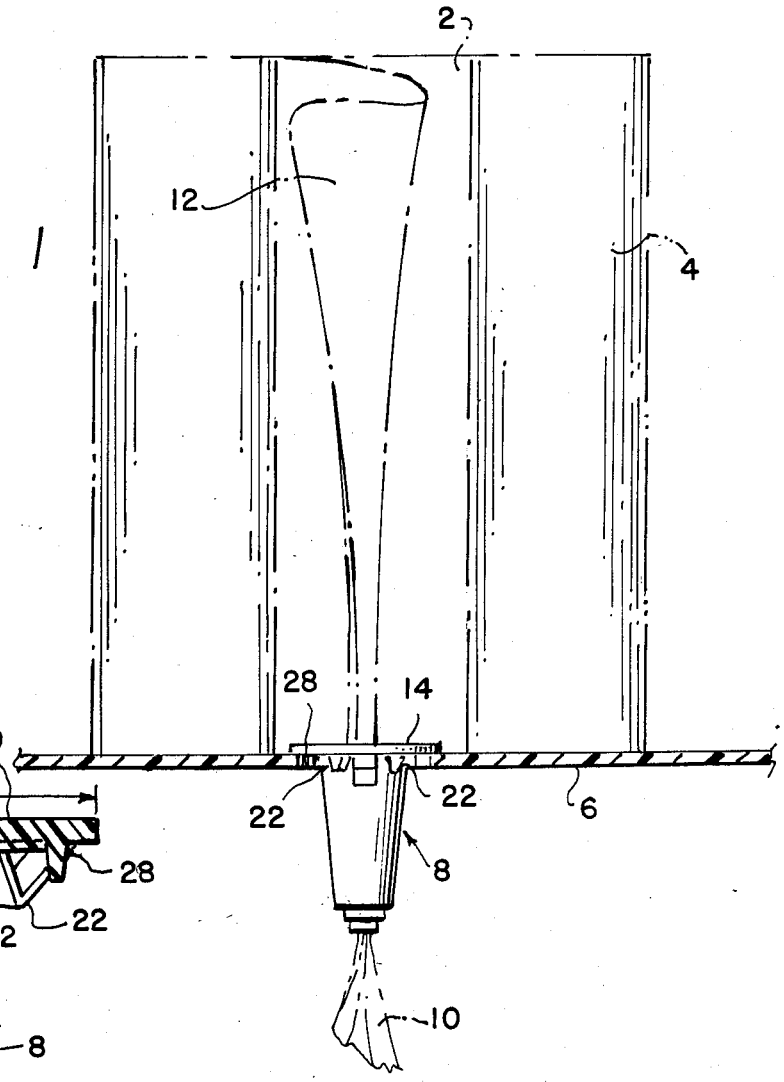
FIG. 1 is a cross-sectional view of the paper towel container with the nozzle coupled thereto.

FIG. 1 shows a paper towel roll 2 contained within a paper towel container 4 which has a base member 6. Nozzle 8 is coupled to base 6 so as to protrude therefrom. A first paper towel 10 is depicted exiting the nozzle 8 while a following paper 12 is shown unwrapping from roll 2 and entering nozzle 8.

Figure 2:
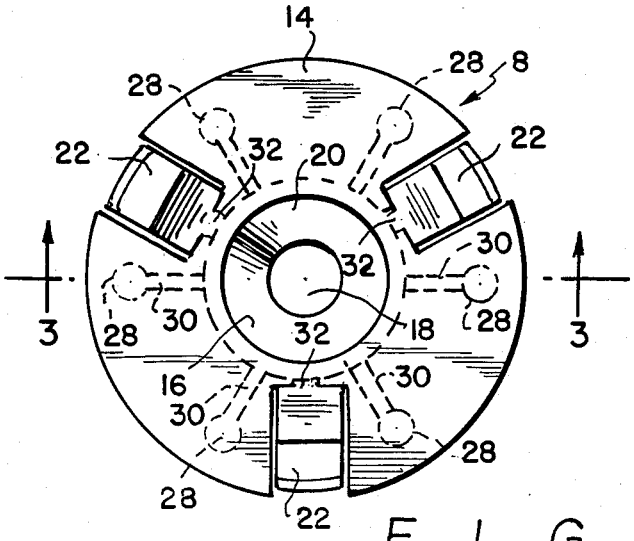
FIG. 2 is a top view of the nozzle.

FIG. 2 is a top view of nozzle 8 and depicts the circular flange 14 and the frustoconical funnel 16. The bottom of the funnel includes an opening 18 which is preferably circular in shape and sized so that first paper towel 10 will reliably separate from following paper towel 12 after a leading portion of paper towel 12 exits from opening 18.

The top portion of funnel 16 includes an opening 20 which is sized to appropriately accept the insertion of paper towel 12.

Also visible in FIG. 2 are flexible support members 22 which are used to couple the flange 14 to the paper towel container base 6. Support members 22 are preferably flexible, acutely bent projections so that the nozzle 8 may be easily and removably snapped into base 6. The bent projections 22 flexibly move in a radial direction with respect to a longitudinal centerline of said nozzle. Base 6 has an appropriately shaped opening to engage the support members 22 to lock the nozzle onto base 6. Those having skill in this field will recognize that any convenient and reliable means of coupling the nozzle 8 to the base 6 may be used in this invention. For example, a snap-ring, clips, or other known means may be readily adapted to connect nozzle 8 to base 6.

Figure 3:
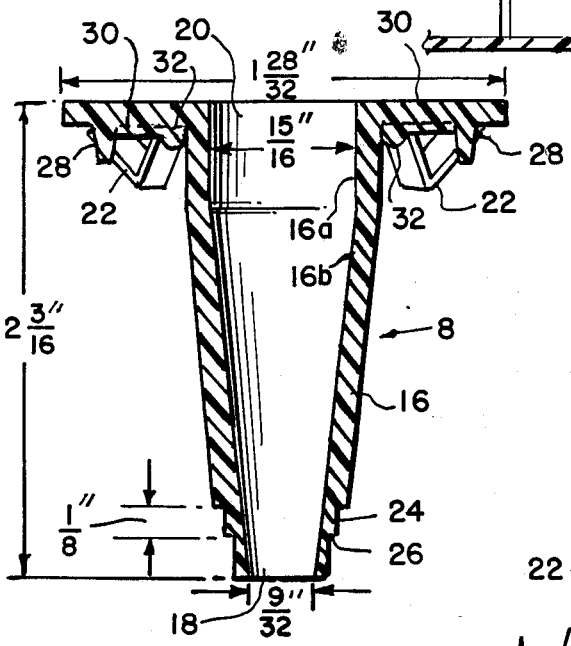
FIG. 3 is a cross-sectional view of the nozzle taken along line 3—3 of FIG. 2.

FIG. 3 depicts a cross-sectional view of nozzle 8, taken along line 3—3 of FIG. 2. FIG. 3 depicts the nozzle dimensions believed appropriate to provide accurate and reliable separation of one paper towel from another. For example, the diameter of opening 18 is set at 9/32 of an inch in order to reliably separate first paper towel 10 from following paper towel 12. The length of the nozzle is approximately 2 and 3/16 inches, with the diameter of opening 20 being approximately 15/16 of an inch. With the above-described dimensioning of the entrance hole 20, exit hole 18, and the length of nozzle 8, it is believed that reliable separation of towels will occur at the perforation boundary therebetween. However, persons of ordinary skill in this field should understand that modification of the dimensions may be made without departing from the spirit of the claimed invention.

FIG. 3 also depicts a novel feature according to the present invention in which the diameter of exit hold 18 may be varied in order to adjust nozzle 8 to accommodate a wide variety of paper towels. Therefore, indents 24 and 26 are formed in the outside surface of funnel 16 to create a plurality of removable sections therein. Thus, the exit portion of funnel 16 has one or more narrow neck portions adapted for easy removal from the funnel. The operator merely removes (by cutting, clipping, or breaking, etc.) excess nozzle in order to adjust the inside diameter of opening 18. Thus, detachable sections are included at the end of nozzle 16 to conveniently accommodate the different sizes and thicknesses of paper towels used. Persons of skill in the field will understand that the varying of exit opening 18 may be accomplished with adjustable structure such as a collapsible funnel which may be moved to increase or decrease opening 18 and then locked into place. Later, the adjustable structure could be moved to accommodate a different size of paper towel.

Preferably, nozzle 8 is constructed as a single, integral, rigid, plastic piece capable of being formed by injection molding techniques. It is preferred that nozzle 16 is rigid in order to provide long life and reliable use for paper towel users.

Figure 4:
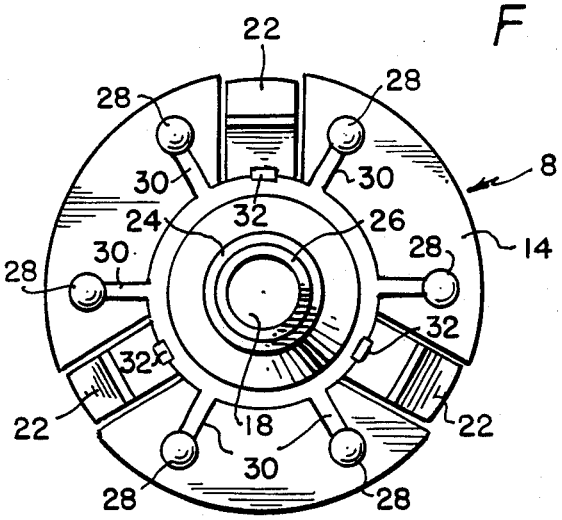
FIG. 4 is a bottom view of the nozzle.

FIGS. 1, 2, 3, and 4 depict projections 8 which are used to align nozzle 8 in base 6. These projections 28 are formed on the bottom of flange 14 and engage alignment holes in base 6. Each projection 28 fits within a corresponding recess in base 6 in order to provide proper alignment and structural rigidity between nozzle 8 and base 6. Depicted in FIGS. 2, 3, and 4 are stiffening members 30 which are used to stiffen projections 28 against wear and repeated stress. These stiffening members are positioned between the outside of funnel 16 and each projection 28.

Likewise, flexible supports 22 may also include stiffening members 32 to provide long life and support to flexible members 22.

In FIG. 3 it is shown that funnel 16 may comprise a circular entry portion 16*a* and a conical funnel portion 16*b*. The portion 16*a* is positioned at the entrance to funnel 16 and acts to introduce the paper towel into the nozzle 8. Then, cone-shaped funnel portion 16*b* acts to compress the paper towel as it travels from the entrance opening 20 to the exit opening 18. As the paper towel compresses, friction increases between the inside wall of cone-shaped portion 16*b* and the paper towel itself. This increased friction increases the resistance force on the towel as it is extracted from exit opening 18. Eventually, the friction between the paper towel and the funnel 16 reaches a point where the resistance force on the towel exceeds the force required to break the paper towel along its perforation boundary. When this happens, the first towel 10 will be separated from following towel 12.

FIG. 4 depicts a bottom view of nozzle 18 clearly showing projections 28, and stiffening members 30, 32.

Figure 5:
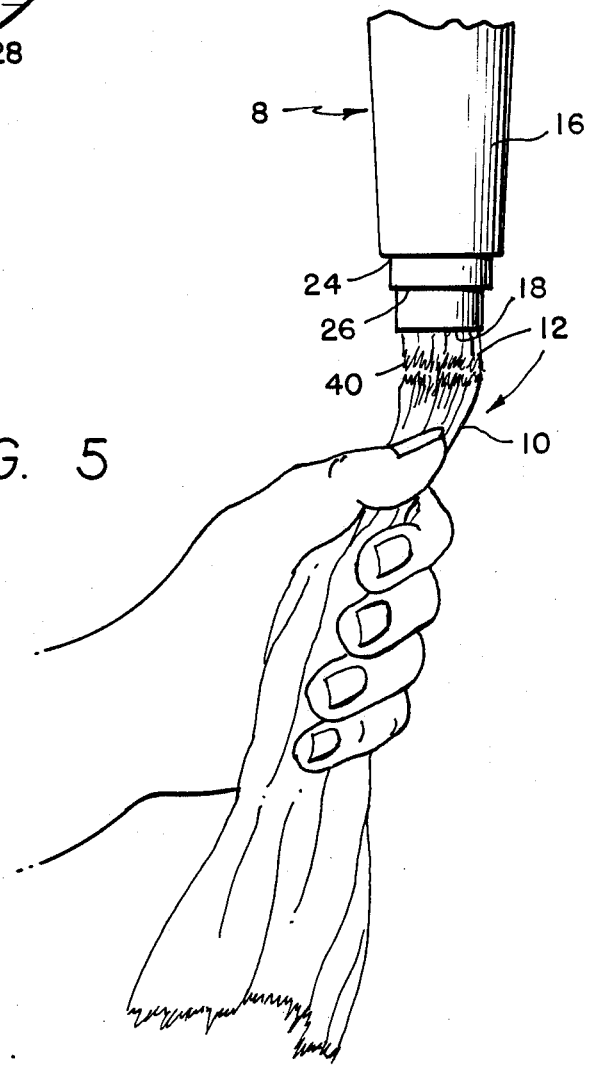
FIG. 5 is a side view of a leading and following paper towel breaking along their perforation boundary.

FIG. 5 depicts the nozzle according to the present invention in operation. As the operator pulls the first towel 10 from opening 18 of nozzle 8, the friction between following towel 12 and funnel 16 exceeds the force required to break perforation boundary 40 between first towel 10 and following towel 12. At such a point, first towel 10 separates and leaves a leading portion of following towel 12 exposed from exit opening 18. Thus, the operator can easily grasp the leading portion of following towel 12 for the next towel dispensing operation. If the towels inside the container are two-ply towels and therefore thicker, the operator may detach a portion of the exit end of funnel 16 at detent 26. Likewise, if a three-ply towel is to be dispensed, or if the one-or two-ply towels within the container are extremely thick, a further portion of the nozzle 16 may be removed at detent 24.

In the present embodiment, it is advantageous for the entire structure of nozzle 8 to be symmetrical with respect to a longitudinal axis passing therethrough. This ensures that reliable towel dispensing may be conducted from any angle or any position with respect to the towel container. It is also preferable that the nozzle 8 be constructed of a translucent or transparent material so that any obstructions or malfunctions can be readily recognized without disassembling the nozzle from the container.

Thus, what has been described is a compact, reliable, rugged and accurate towel dispenser capable of dispensing a wide variety of paper towels from any desired position. The nozzle can be easily snapped into a paper towel dispenser, or removed therefrom for maintenance or replacement. Furthermore, the unitary construction of the flange and nozzle ensures a long life and accurate towel dispensing.

While the present invention has been described in what is believed to be the most practical and preferred embodiments, it is to be understood that the teachings of this invention encompass all modifications and equivalent structures capable of performing the functions outlined by the following claims.

What is claimed is:

1. Dispenser nozzle apparatus for a towel container holding a plurality of perforated towels, comprising:

flange means for coupling said nozzle apparatus to said container; and conical funnel means, integral with said flange means and having (a) an entrance opening and (b) an exit opening smaller than said entrance opening, for dispensing said towels from said entrance opening to said exit opening to cause a first towel to separate from a second towel along a perforation boundary therebetween after a leading portion of said second towels exits from said exit opening, said conical funnel means including a substantially cylindrical portion adjacent said entrance opening and a substantially frusto-conical portion disposed between said cylindrical portion and said exit opening.

2. Apparatus according to claim 1 wherein said funnel means includes at least one adjustable portion adjacent said exit opening, for changing a size of said exit opening.

3. Apparatus according to claim 2 wherein said funnel means includes two adjustable portions to cause three different sizes of exit openings to be selectable.

4. Apparatus according to claim 1 wherein said nozzle apparatus comprises a rigid material.

5. Apparatus according to claim 1 wherein said flange means includes flexible support means for coupling said flange means to said container.

6. Apparatus according to claim 5 wherein said flexible support means includes three angled members which are radially movable from a centerline of said funnel means.

7. Dispenser nozzle apparatus for dispensing perforated towels from a towel container, comprising:

circular flange means for coupling said apparatus to said container; and cone-shaped, rigid funnel means, coupled to said flange means, for dispensing said towels from said container through said funnel means, and for causing a first towel to separate from a following towel along a perforation boundary therebetween when a leading portion of said following towel has exited from said funnel means, said funnel means having a substantially cylindrical portion adjacent said flange means and a substantially frusto-conical portion integral with an end of said cylindrical portion.

8. Apparatus according to claim 7 wherein said funnel means includes:

an entrance portion adjacent said flange, for accepting said towels from said container, said entrance portion having a hollow, conical shape; and a funnel portion coupled to said entrance portion, for compressing said following towel as it proceeds through said funnel means, said funnel portion having a hollow, conical shape.

9. Apparatus according to claim 8 wherein said funnel portion includes at least one removable portion, at an end opposite said entrance portion, to cause an exit opening of said funnel portion to be adjustable in size.

10. Apparatus according to claim 7 wherein said flange means includes a plurality of flexible support members for coupling said flange means to said container.

11. Apparatus according to claim 10 wherein said flange means includes stiffening means positioned between said funnel means and each of said flexible support members.

12. Apparatus according to claim 7 wherein said flange means includes a plurality of rigid projections for aligning said nozzle apparatus to said container.

13. Apparatus according to claim 12 wherein said flange means includes stiffening means positioned between said funnel means and each of said projections.

14. Dispenser apparatus for dispensing paper towels from a container holding a roll of perforated paper towels, comprising:

flange means for coupling said apparatus to said container, said flange means including a plurality of flexible support members for engaging said container and a plurality of rigid projections for aligning said flange means with said container; and frusto-conical shaped funnel means, integral with said flange means and having a circular entrance portion and a circular exit portion with a diameter smaller than said entrance portion, for dispensing said towels from said container through said entrance portion to said exit portion to cause a first towel to separate from a following towel along a perforation boundary therebetween when a leading portion of said following towel has exited said exit portion.

15. Apparatus according to claim 14 wherein said entrance portion includes a hollow, cylindrical-shaped base portion fixed to said flange means.

16. Apparatus according to claim 14 wherein said funnel means exit portion includes at least one removable portion to cause the diameter of said exit portion to be changeable.

17. Apparatus according to claim 14 wherein said funnel means exit portion includes at least one narrowed neck whose removal will change an inside diameter of said exit portion.

18. Apparatus according to claim 14 wherein said apparatus comprises a single, integral structure made of a rigid, plastic material.

19. Apparatus according to claim 14 further including a plurality of stiffening members, one positioned between said funnel means and each of (a) said flexible support members, and (b) said projections.

20. Apparatus according to claim 14, wherein said frusto-conical shaped funnel means includes a substantially cylindrical portion adjacent said flange means and a substantially frusto-conical portion disposed between said substantially cylindrical portion and said circular exit portion.

* * * * *